United States Patent [19]

Turk et al.

[11] 4,241,574

[45] Dec. 30, 1980

[54] SPINNING PROCESS AND APPARATUS

[75] Inventors: Herbert Turk, Remscheid; Herbert Schiminski, Hückswagen, both of Fed. Rep. of Germany

[73] Assignee: Barmag Barmer Maschinenfabric AG, Remscheid-Lennep, Fed. Rep. of Germany

[21] Appl. No.: 7,944

[22] Filed: Jan. 30, 1979

[30] Foreign Application Priority Data

Jan. 30, 1978 [DE] Fed. Rep. of Germany ..... 2803904

[51] Int. Cl.[3] ..... D01H 1/12

[52] U.S. Cl. ..... 57/200; 57/5; 57/58.89; 57/58.95

[58] Field of Search ..... 57/5, 6, 58.89–58.95, 57/200

[56] References Cited

U.S. PATENT DOCUMENTS

| | | | |
|---|---|---|---|
| 4,107,909 | 8/1978 | Fehrer et al. | 57/5 |
| 4,109,454 | 8/1978 | Fehrer et al. | 57/58.95 |
| 4,130,983 | 12/1978 | Dammann et al. | 57/5 |
| 4,165,600 | 8/1978 | Schippers et al. | 57/58.95 |

*Primary Examiner*—John Petrakes

*Attorney, Agent, or Firm*—John H. Shurtleff

[57] ABSTRACT

A process and apparatus for producing a thread from staple fibers by the open-end or round-about spinning methods wherein the individual fibers are transported by an air stream to the thread forming zone in the nip between two air-permeable rollers with suction applied from within the rollers, characterized by the use of a fiber-transporting air stream directed at an angle of impingement with reference to the thread forming zone of less than 45°, preferably 10° or even less, with a vector of movement of the air stream being counter to the thread draw-off direction. An improved thread or yarn product is obtained by this process, being more compact and free of loose fibers.

16 Claims, 3 Drawing Figures

SPINNING PROCESS AND APPARATUS

BACKGROUND OF THE INVENTION

A number of processes and apparatus have been developed to carry out an "open-end" spinning process or a "round-about" spinning process. For example, as discussed on pages 322–327 of the book "Textile Yarns Technology, Structure, & Applications" by B. C. Goswami et al, John Wiley & Sons, New York (1977), the open-end spinning process may also be referred to by the term "break spinning" since a roving is broken at one point into individual fibers and the fibers transferred to another point for reassembly into a thread or yarn. In a round-about spinning, a continuous core thread or filament is fed along the line of thread formation with the individual fibers being reassembled therearound as a sheath or outer layer.

A typical method of open-end spinning is disclosed in Malliand Textilberichte 1975, Vol. 9, pages 690 ff., where a card sliver or roving of staple fibers is first separated into the individual fibers by means of a rapidly rotating roller, the fibers then being transferred to a rotating cylindrical sieve drum. Rotation of this drum introduces a moment of torsion into the collected fiber mass so that the individual fibers are assembled into a more or less compact bundle along a line of filament or thread formation on the drum with a real twist imparted to form the thread or yarn. This process presents certain disadvantages because the thread being formed tends to be very unstable in its position on the drum, resulting in uneven thread diameters and frequent thread breakage.

Another known process of this type is disclosed in the German Offenlegungsschrift No. 24 49 583 wherein the individual fibers are twisted into a thread or yarn in the nip between two rollers or sieve drums which rotate in the same direction around parallel axes. The individual fibers are fed perpendicularly to the direction in which the formed thread is drawn off from the nip. Inside of each of the drums is an air suction device, the open end of which is directed toward the nip in which the thread is formed. Air currents produced by the suction devices press the fibers against the drum walls in the region of the nip. This particular method is disadvantageous in that the air currents produced by suction oppose the desired direction of twisting the thread. Again, it is most difficult to achieve stable thread forming conditions except by using extraordinary measures.

According to the specifications of the German Offenlegungsschriften No. 26 56 787 and No. 27 39 410, the individual fibers are introduced by an air stream through a feed channel into the thread forming zone extending in the narrowest gap between rollers. Here, the feed channel is inclined toward the thread forming zone in such a way that the air stream has a vector of movement in the draw-off direction of the thread. German Offenlegungschriften No. 27 39 410 corresponds to U.S. application Ser. No. 937,798, filed Aug. 29, 1978, now U.S. Pat. No. 4,165,600.

An especially useful open-end or round-about spinning process with suitable apparatus is disclosed in our earlier U.S. application with coinventors Dammann and Schippers, Ser. No. 782,310, now U.S. Pat. No. 4,130,983. In this case, various feed arrangements are used to convey the individual fibers into the thread forming zone, i.e. into the narrowest gap formed between oppositely moving air-permeable surfaces of paired sieve belts, drums or rollers, said gap lying between parallel belts or in a plane substantially normal to the curved surfaces of the drums or rollers. The individual fibers may be fed perpendicularly to the line of rotating thread formation in said gap but are generally introduced into the gap by an air stream with a substantial component or vector of movement in the same direction as the thread draw-off.

When spinning fibers of a certain origin in the earlier described processes, a problem has existed in that a relatively large proportion of the spinning fibers tend not to be twisted into the thread or to be only incompletely twisted into the thread, thereby causing an impairment of the strength, workability, handle and appearance of the thread or yarn product. This problem is only partially avoidable by means of a very sensitive machine adjustment, the processing variables being difficult to control and never precisely reproducible.

SUMMARY OF THE INVENTION

It is an object of the present invention to avoid the problems and disadvantages found in the earlier open-end and round-about spinning processes and to improve the quality and properties of the thread or yarn produced by these processes, particularly so as to achieve a more compact and uniform thread in which unbound or partly unbound fibers are reduced to a degree which is of little or no consequence in practice. The optimum thread or yarn product produced by the process of the invention is substantially free of loose fibers or poorly bound fibers.

It is also an object of the invention to substantially completely avoid the adverse effect on thread quality caused by differences in velocity as between the feed velocity of the individual fibers to the thread forming zone and the velocity at which the thread is drawn off from said forming zone. Thus, it has been found that by feeding discrete fibers perpendicularly to the thread draw-off direction and with components in the thread suction means determiner according to the setting of the feed velocity and thread draw-off velocity, a deformation of the individual fibers takes place as they impinge on the thread during its formation. Because of this deformation, the discrete, individual fibers fail to become bound or fastened into the thread or else become only incompletely bound or fastened into the formed thread. Such disadvantageous effects can be overcome with the process and apparatus proposed by the present invention.

The objects and advantages of the invention are essentially achieved by directing the air stream feeding the discrete fibers so as to impinge upon the thread formation line at an impingement angle of less than 45° with a vector of movement of the air stream being counter to the thread draw-off direction. This particular step results in a surprisingly effective improvement in thread quality, eliminating the harmful effects caused by differences in velocity as between fiber feed velocity and thread draw-off velocity.

The improvement of the invention is generally adapted to the known process for spinning individual fibers into a thread or yarn by the open-end or round-about technique wherein discrete fibers are fed in an air stream to the narrowest gap which is formed by two air-permeable rollers or drums rotating in the same direction, the discrete fibers being pressed against the roller surfaces by means of air suction devices disposed within the rollers and being twisted together into a thread along a line of rotating thread formation in the region or zone of the narrowest gap by the oppositely moving contact of the roller surfaces. Of these known processes, especially good results are obtained by following the teaching of the Dammann et al U.S. Pat. No. 4,130,983, particularly by including that feature in which the coacting air currents of the suction devices are directed in a twist-assisting flow direction, i.e. such that vectors of movement of the roller surfaces and the vectors of movement of said suction air currents are the same as the direction of rotating thread formation. These suction air currents are preferably disposed on opposite sides of the yarn forming zone so as to provide vectors of movement together with those of the roller moving surfaces which collectively encircle the yarn being formed. In order to avoid unnecessary repetition, the disclosure of U.S. Pat. No. 4,130,983 is incorporated herein by reference as fully as if set forth in its entirety.

The improvement in apparatus according to the present invention is likewise based upon known apparatus, especially that disclosed in said U.S. Pat. No. 4,130,983, which can be described as having two rollers with air-permeable mantle surfaces arranged for rotation in the same direction and spaced from each other to provide a thread forming zone bounded by two mantle lines lying on substantially one common plane and corresponding to the respective generatrix lines of the rollers along the narrowest gap therebetween. This known apparatus further includes an air suction means in each roller to draw or suction off air currents in the area of the thread forming zone, preferably to produce suction air currents on either side of the thread forming zone in the direction of thread rotation according to said U.S. Pat. No. 4,130,983. According to the present invention, the improvement in the apparatus requires a feed channel for the individual fibers which is inclined at an angle of less than 45° with reference to the thread forming zone, i.e. as defined by said mantle lines or, more precisely, by the axis of rotation of the thread being formed between said mantle lines. The feed channel must also be arranged to direct the fiber-feeding air stream counter to the direction in which the formed thread is drawn off.

In both the process and apparatus of the invention, it has been found to be desirable to provide a feed channel and its fiber-directing air stream with an angle of impingement on the thread formation line which is as small as possible as well as being counter to the direction of thread draw-off. Especially advantageous results can be achieved if the impingement angle is less than 10°. In general, the best results are obtained with an impingement angle of not more than about 30° and preferably below about 15°.

Especially good results are also observed in the process and apparatus of the invention if the roller surfaces acting to twist the fiber mass or to form a round-about sheath are so constructed and arranged as to provide a vector of movement which imparts an axial conveying motion to the thread in its direction of draw-off. The air stream of the fiber feed channel is then also directed against or counter to this component of conveying motion.

In order to provide this conveying motion to the formed thread, it is especially useful to use rollers formed as the hyperboloids earlier described in said U.S. Patent No. 4,130,983, or with one roller being cylindrical in shape and the other roller being hyperboloid in shape, each having a generatrix arranged substantially parallel to that of the other on either side of the nip or narrowest gap bounding the thread forming zone.

Preferred hyperboloids according to the apparatus of the present invention are those which are asymmetrical in shape with a smaller cross-sectional diameter on the outlet side where the thread is drawn off than on the inlet side, e.g. such that the feed channel is directed inwardly into the thread forming zone represented by the nip or narrowest gap from said outlet side of smaller diameter. Here, the rollers as hyperboloids are best cut off on their outlet side in the region of their narrowest diameter.

It should be noted that the fiber feed channel, as seen in the running direction of thread draw-off, has a front wall and a rear wall which are not parallel to one another. The angle of impingement of the air stream feeding the individual fibers, as measured with reference to the line of thread formation or the angle of inclination of the feed channel with reference to its mouth which opens parallel to the nip or narrowest gap is to be defined in the sense of the present invention by the larger of the two angles. This angle of impingement or angle of inclination will therefore usually be measured from the rear wall since it is most desirable for the feed channel to widen out as it approaches the zone of thread formation.

In order to control the distribution and orientation of individual fibers in the air stream flowing through the feed channel, it is preferable to provide a plurality of air jets directed into the channel in the direction of fiber transfer toward the thread forming zone. It is especially desirable to provide at least one air jet in the front wall of the feed channel to provide an air stream vector counter to the thread draw-off direction and almost parallel or at a very slight angle thereto, e.g. less than 10°. Such a jet stream assists in an orientation of the entrained fibers so that they will lie more parallel to the line of thread formation as they enter the nip or narrowest gap between the rollers.

Staple fibers of any source can be used for the process of the present invention and the thread or yarn being produced can vary from very low to relatively high yarn sizes (denier). It is also possible to use mixtures of different fibers and a separate feed channel for each type of fiber to provide a combined mixing and spinning process (see U.S. Pat. No. 4,130,983).

THE DRAWINGS

DESCRIPTION OF PREFERRED EMBODIMENTS

Figure 1:
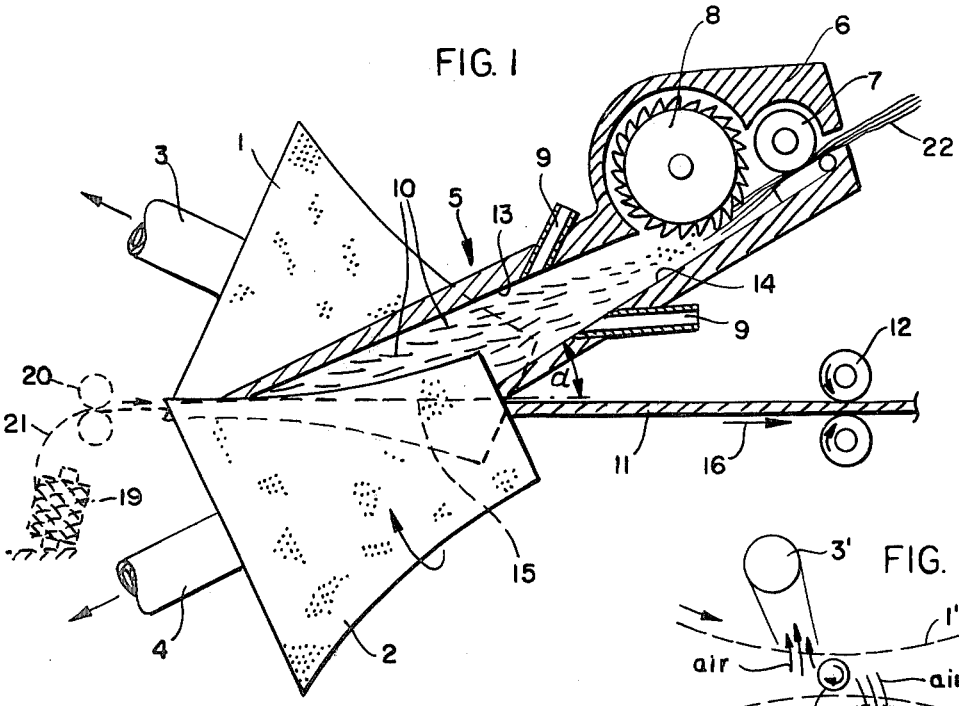
FIG. 1 is a sectional view along the axis of thread formation of one preferred embodiment of the invention, including a schematic representation of suitable means of supplying a continuous core filament.
Figure 3:
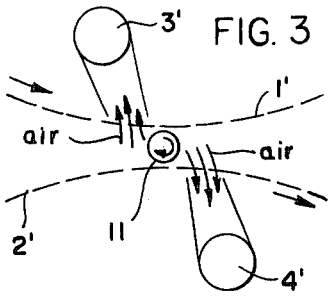
FIG. 3 is a schematic view of a preferred arrangement of suction devices within the two air-permeable rollers.
Figure 2:
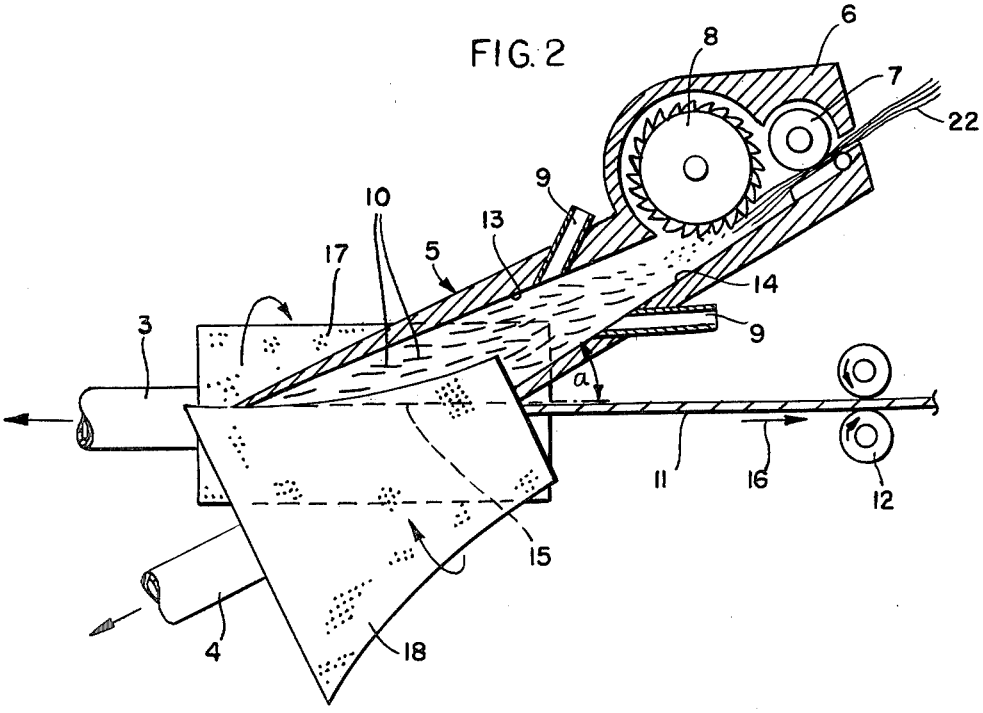
FIG. 2 is a sectional view similar to FIG. 1 but illustrating another preferred embodiment using a different set of air-permeable rollers.

The individual embodiments of the invention given by way of preferred examples are quite similar in construction and arrangement so that the same or similar reference numerals are used in each of the different figures. In FIG. 1, the two rollers 1 and 2 are constructed as asymmetrical hyperboloids, each having its front end, viewed in the direction of the running thread 11, being cut off at the point of narrowest diameter of the hyperboloid. In FIG. 2, one of the rollers 18 is the same hyperboloid as in FIG. 1, while the other roller 17 is in the form of a cylinder having its axis of rotation parallel to the line of rotating thread formation. FIG. 3 may be considered together with either FIG. 1 or FIG. 2, illustrating the direction of roller movement as in two cylindrical rollers 1' and 2' and also the direction of suction air currents acting together around the rotating thread 11 as it is being formed.

Each of the rollers shown in the drawing is perforated and permeable to air, these rollers being driven at the same speed and in the same direction of rotation by suitable drive motors (not shown here but see FIGS. 4 and 4*a* of U.S. Pat. No. 4,130,983).

Air suction devices are arranged inside of each of the rollers as shown schematically in FIG. 3 and in greater detail in said U.S. Pat. No. 4,130,983, so that the mouths of these suction devices run parallel to the mantle lines or generatrices of the rollers which define the nip (narrowest gap) formed between the rollers. The air suction lines or conduits 3, 4 or 3',4' are connected to an air vacuum or air exhausting means to create the desired air suction currents, preferably in the manner illustrated by the arrows labeled "air" in FIG. 3.

Each suction mouth preferably lies in front of the line of thread formation, as viewed in the direction of movement of the respective roller surface in the nip region, and there may be provided an overlapping to a slight extent of the opposing suction mouths up to about ten times the thread diameter, e.g. as set forth in detail in the description of FIG. 2*a* of U.S. Pat. No. 4,130,983. This preferred construction and arrangement of the suction devices may be adopted for purposes of the present invention.

Into the nip or curved wedge opening between the rollers in each embodiment, the fiber feed channel 5 is positioned at its open end or mouth 15 substantially parallel to the nip or so-called narrowest gap. At the entry end of the feed channel 5, there is added or connected a housing 6 containing means to loosen and separate the initial roving or sliver 22 into the individual fibers 10. This roving 22 is introduced by means of the intake or feed roller 7 and the individual fibers separated in known manner by means of the toothed carding or loosening roller 8 for transfer of the fibers 10 as discrete linearly oriented particles or fibrous bodies. The axis of rotation of the carding roller 8 can be arranged as shown to extend transversely or perpendicularly to the line of thread formation; however, this carding roller axis may also lie in the same plane as the line of thread formation, i.e. so as to lie parallel to the fiber feed channel 5.

The individual fibers 10 are positively conveyed and oriented in the feed channel 5 by means of the air stream produced by the injectors or jet nozzles 9 so as to direct these separated fibers toward and into the nip (narrowest gap) between the two rollers. The individual fibers tend to impinge upon the roller surfaces as directed further by the air suction currents which act to press the fibers and hold them briefly along the roller surfaces on each side of the line of thread formation. The two moving surfaces of the rollers, which move in opposite directions on each side of the thread forming zone, create a twisting moment in the fiber mass which results in the formation of the twisted thread 11 or, as indicated in FIG. 1, a sheath spun around the core filament 21 drawn off from the delivery bobbin 19 by means of the paired feed rolls 20. The produced thread 11 is preferably drawn off by means of a similar set of paired conveyance or draw-off rollers 12, also indicated by FIG. 1 and by FIG. 2.

The feed channel itself consists essentially of the front wall 13 and the back or rear wall 14, as viewed in the cross-section given by FIGS. 1 and 2 and viewed in the direction of the thread draw-off, together with its mouth 15 substantially parallel to the narrowest gap between the rollers. This mouth 15 preferably extends over more than one-third of the gap length. The side walls 13 and 14 are inclined with reference to the line of thread formation and thus the corresponding mouth position at the angle $\alpha$, i.e. as measured from the rear wall 13 which has the largest angle.

Although it has been known to provide an inclined feed channel to supply the individual fibers, it was surprising to discover that the open-end or round-about spinning would be remarkably improved by the simple expedient of inclining the feed channel in a direction such that the individual fibers 10 impinge upon the line of thread formation with a component or vector of movement against or counter to the draw-off direction 16 of the thread 11. Contrary to expectation, this arrangement of the feed channel results in a highly desirable linear incorporation of the discrete fibers into the spun thread such that practically every fiber is bound in or fastened within the thread over the entire fiber length. In this manner, the compactness of the produced thread or yarn is considerably improved. Furthermore, a stripping off of unbound fibers is avoided and the appearance of so-called "belly binders" formed by only partly bound fibers is also substantially avoided.

As previously noted, the side walls 13 and 14 need not be parallel to one another. The angle $\alpha$ is defined as the angle between the steepest side wall, in this case the rear wall 13, and the mouth 15 or the line of thread draw-off 16, this critical angle $\alpha$ always being less than 45°, preferably under 30°, and especially below about 10° or 15°. The smaller the chosen angle, the more favorable is the result in terms of thread quality. It will be obvious that the lower limit for this critical angle is dependent upon the geometry of the rollers and the practical mechanical construction of the feed channel and the other machine elements.

If, for any reason, it is desirable to form and draw off the thread in another direction than that illustrated here, e.g. opposite to the arrow 16, then the fiber feed channel must also be correspondingly modified to provide the essential angle of inclination.

The particular embodiment of FIG. 2 is identical in all essential details to that of FIG. 1 except that the primary spinning assembly consists of the cylindrical roller 17 on the one hand and the hyperboloid roller on the other hand. The cylindrical roller is arranged such that its generatrix forms the nip or narrowest gap with a straight line generatrix of the hyperboloid roller 18, the thread being formed by the action of both rollers moving in opposite directions on either side of the narrowest gap. Both rollers 17 and 18 are permeable to air and also contain the required suction devices on their interior as indicated by the air suction conduits 3 and 4. This combination of a cylindrical and hyperbolic roller permits a somewhat simpler execution of the wedge-like narrowing of the nip between the rollers, since there are no objectionable intersections or overlapping projections as occurs in machine construction using two hyperboloids.

It is an important advantage to provide at least one roller in the form of a hyperboloid because this combination offers a useful thread conveying function of the rollers. Thus, when using two hyperboloids or one hyperboloid and one cylinder as the rollers, they produce a vector of movement imparting an axial conveying motion to the formed thread in its desired draw-off direction. This conveying movement can also be assisted by a slight narrowing of the nip in the draw-off direction or by disc members at the outlet end of the rollers or other suitable means.

The present invention not only improves the process of open-end or round-about spinning but also leads to an essentially improved yarn or thread product characterized by its greater compactness, uniform diameter and a substantial absence of loose fibers or undesirable "belly binds" or the like. The invention is not to be restricted to the preferred embodiments described above. The invention is also advantageously used on spinning devices having two cylindrical rollers, hyperboloid rollers of different shapes or configurations, truncated conical rollers, or all such rollers combined with suction devices installed within the rollers in ways other than that described. On the other hand, the best mode of the invention is believed to reside in the particular embodiments shown, especially when adopting the essential features of the earlier Dammann et al patent, U.S. Pat. No. 4,130,983. In this most preferred form of the invention, there is an arrangement of the rollers and suction devices whereby these elements cooperate in a twist-assisting flow direction and which tend to ensure a stable thread formation in a safe and well-controlled spinning operation and to guarantee a high thread quality, especially at low thread deniers.

The invention is hereby claimed as follows:

1. In a process for spinning individual fibers unto a thread or yarn wherein discrete fibers are fed in an air stream to the narrowest gap which is formed by two air-permeable rollers or drums rotating in the same direction, said discrete fibers are pressed against the roller surfaces by means of air suction devices disposed within the rollers and are twisted together into a thread along a line of rotating thread formation in the region of said narrowest gap by the oppositely moving contact of the roller surface, and the thread is drawn off at one end of the roller surfaces, the improvement which comprises:

directing the air stream feeding the discrete fibers so as to impinge upon the thread formation line at an impingement angle of less than 45° with a vector of movement of said air stream being counter to the thread draw-off direction.

2. A process as claimed in claim 1 wherein said impingement angle is less than 30°.

3. A process as claimed in claim 1 wherein said impingement angle is less than about 15°.

4. A process as claimed in claim 1 wherein said impingement angle is less than about 10°.

5. A process as claimed in claim 1 wherein the rollers have a vector of movement imparting an axial conveying motion to the thread along the line of thread formation and in the thread draw-off direction.

6. A process as claimed in claim 1 wherein a continuous filament is conveyed axially through said narrowest gap along the line of rotating thread formation such that said filament becomes the core of the thread being formed.

7. A process as claimed in claim 1 wherein said thread is formed between two rollers, each having cylindrical rotating moving surfaces.

8. A process as claimed in claim 1 wherein said thread is formed between two rollers, each having hyperbolically concave rotating moving surfaces.

9. A process as claimed in claim 1 wherein said thread is formed between two rollers, one having a cylindrical rotating moving surface and the other having a hyperbolically concave rotating moving surface.

10. A process as claimed in claim 1 wherein the vectors of movement of said roller surfaces and coacting air currents created by suction are adjusted together with said air stream directed counter to the thread draw-off direction such that substantially all of the fibers forming said thread are fastened into the thread over their entire lengths, thereby providing a thread of improved compactness and substantially free of loose fibers.

11. The thread product obtained by the process of claim 10.

12. In an apparatus for the production of a thread or yarn from individual, discrete fibers, said apparatus having two rollers with air-permeable mantle surfaces arranged for rotation in the same direction and spaced from each other to provide a thread forming zone bounded by two mantle lines lying on substantially one common plane and corresponding to the respective generatrix lines of the rollers along the narrowest gap therebetween, an air suction means in each roller to draw off air currents in the area of said thread forming zone, a feed channel to supply said individual fibers by means of an air stream directed into said channel and extending into the region of said narrowest gap where said channel opens with a mouth substantially parallel to said gap, and means to draw off the formed thread at one end of said gap, the improvement which comprises:

a feed channel for said individual fibers which is inclined at an angle of less than 45° with refernece to the thread forming zone, as defined by said mantle lines, and which is arranged to direct said air stream counter to the direction in which the formed thread is drawn off.

13. Apparatus as claimed in claim 12 wherein said rollers are formed as hyperboloids which provide a vector of movement imparting an axial conveying motion to the formed thread in its drawn off direction, the feed channel providing an air stream directed against said conveying motion of the hyperboloids.

14. Apparatus as claimed in claim 13 wherein said rollers as hyperboloids are asymmetrical in shape such that on the outlet side where the formed thread is drawn off, they have a smaller diameter than on the inlet side, and said feed channel is directed from the side of smaller diameter into said thread forming zone corresponding to said narrowest gap.

15. Apparatus as claimed in claim 14 wherein said rollers as hyperboloids are cut off on the outlet side in the region off their smallest diameter.

16. Apparatus as claimed in claim 12 wherein one of said rollers is formed as a cylinder and the other of said rollers is formed as a hyperboloid with its generatrix adapted to that of the cylinder roller to provide a vector of movement imparting an axial conveying motion to the formed thread in its drawn off direction, the feed channel providing an air stream directed against said conveying motion.

* * * * *